US007204715B2

(12) United States Patent
Kukita

(10) Patent No.: US 7,204,715 B2
(45) Date of Patent: Apr. 17, 2007

(54) COAXIAL CONNECTOR

(75) Inventor: Hiroaki Kukita, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/889,426

(22) Filed: Jul. 12, 2004

(65) Prior Publication Data

US 2005/0014416 A1 Jan. 20, 2005

(30) Foreign Application Priority Data

Jul. 17, 2003 (JP) ..... 2003-275823

(51) Int. Cl.
*H01R 9/05* (2006.01)

(52) U.S. Cl. ..... 439/582

(58) Field of Classification Search ..... 439/582, 439/581, 578

See application file for complete search history.

(56) References Cited

U.S. PATENT DOCUMENTS

| | | | | |
|---|---|---|---|---|
| 6,264,475 | B1 * | 7/2001 | Machado | 439/63 |
| 6,508,668 | B1 | 1/2003 | Yamane et al. | |
| 6,739,907 | B2 * | 5/2004 | Kuroda et al. | 439/582 |
| 2003/0020571 | A1 * | 1/2003 | Clark et al. | 333/260 |

FOREIGN PATENT DOCUMENTS

| | | | |
|---|---|---|---|
| JP | 9-320699 | A | 12/1997 |
| JP | 2001-283999 | A | 10/2001 |
| JP | 2002-270305 | A | 9/2002 |
| JP | 2002-298994 | A | 10/2002 |
| JP | 2003-163058 | A | 6/2003 |

OTHER PUBLICATIONS

Patent Abstracts of Japan; Publication No. 2002-270305; dated Sep. 20, 2002 (2 pages).
Patent Abstracts of Japan; Publication No. 2003-163058; dated Jun. 6, 2003 (2 pages).
Patent Abstracts of Japan; Publication No. 9-320699; dated Dec. 12, 1997 (2 pages).
Patent Abstracts of Japan; Publication No. 2002-298994; dated Oct. 11, 2002 (2 pages).
Patent Abstracts of Japan; Publication No. 2001-283999; dated Oct. 12, 2001 (2 pages).
Japan Office Action for Patent Application No. 2003-275823 dated Mar. 15, 2006 (3 pages).
English Translation of Japan Office Action for Patent Application No. 2003-275823 dated Mar. 15, 2006 (3 pages).
Chinese Office Action for Corresponding Chinese Patent Application No. 200410058908.4 dated Jul. 7, 2006 (4 pages).
English Translation of Chinese Office Action for Chinese Patent Application No. 200410058908.4 dated Jul. 7, 2006 (5 pages).

* cited by examiner

*Primary Examiner*—J. F. Duverne
(74) *Attorney, Agent, or Firm*—Osha Liang LLP

(57) ABSTRACT

A coaxial connector comprises a contact electrically connected with a core of a coaxial cable, a shell electrically connected with a shield of the cable, and a housing that supports the contact and insulates the contact from the shell. The capacitance between the portion consisting of the contact and the part of the core connected thereto together with an insulator exposed out of the shield, and the shell, is adjusted by a capacitance adjustment plate so that the coaxial cable has characteristic impedance of a predetermined value.

16 Claims, 6 Drawing Sheets

COAXIAL CONNECTOR

BACKGROUND OF THE INVENTION

1. Field of the Invention

The present invention relates to a coaxial connector to be connected with a coaxial cable.

2. Description of the Related Art

Where using a coaxial cable, there arises a problem of matching between the characteristic impedances of the coaxial cable and of an object connected to the cable. If the characteristic impedances do not match, a reflection wave occurs at the connection point of the coaxial cable, deteriorating the VSWR (voltage standing wave ratio). Accordingly, it is a practice to use a coaxial cable having characteristic impedance appropriate for an object being connected thereto. For a coaxial connector to be connected with such a coaxial cable, there is known a technology for reducing the size and cost by making innovative changes in the shape thereof (see Japanese published unexamined application No.2002-164132).

In order to connect a coaxial connector with a coaxial cable, a core as an inner conductor and a shield as an outer conductor of the coaxial cable are separated so that these are electrically connected respectively to predetermined terminals of the connector. As a result, the core of the coaxial cable is partly exposed out of the shield. In this state, in the case a high frequency signal at several gigahertz is transmitted through the coaxial cable, matching of characteristic impedances cannot be maintained, and VSWR deteriorates. Here, the characteristic impedance $Z_0$ of a coaxial cable is expressed as follows.

$$Z_0 = \sqrt{\frac{R + j2\pi fL}{G + j2\pi fC}} \quad (1)$$

R: resistance of a coaxial cable per unit length [Ω/cm]
G: conductance of a coaxial cable per unit length [l/Ωcm]
L: inductance of a coaxial cable per unit length [H/m]
C: capacitance of a coaxial cable per unit length [F/m]

However, at a high frequency, because resistance R and conductance G may be neglected, the characteristic impedance $Z_0$ is determined by the ratio of inductance L and capacitance C. In the case the core of the coaxial cable is partly exposed out of the shield, the inductive reactance $X_{L1}$ of the part of the core exposed out of the shield is added to the impedance $Z_0$.

$$X_{L1}=2\pi fL \quad (2)$$

Because the inductance L1 of the exposed part of the core is extremely small in value, when a transmission signal is at several hundred megahertz, the inductive reactance $X_{L1}$ of the exposed part of the core can be neglected. However, with a transmission signal of gigahertz-class, the inductive reactance $X_{L1}$ increases in value, hence making it impossible to neglect the inductive reactance $X_{L1}$. Due to this, the characteristic impedance of the coaxial cable cannot to be maintained, and thereby the VSWR deteriorates.

SUMMARY OF THE INVENTION

It is an object of the present invention to provide a coaxial connector excellent in frequency characteristic that, even when a high frequency signal of gigahertz-class is transmitted through a coaxial cable, the characteristic impedance of the coaxial cable can be maintained thus enabling to improve the VSWR.

According to a first aspect of the present invention, there is provided a coaxial connector comprising a contact, a shell, and a housing. The contact is electrically connected with an inner conductor of a coaxial cable. The shell is electrically connected with an outer conductor of the coaxial cable. The housing supports the contact and insulates the contact from the shell. At least one of the inductance of the portion consisting of the contact and the part of the inner conductor connected thereto other than covered by the outer conductor, and the capacitance between the portion and the shell is adjusted so that the coaxial cable has a characteristic impedance of a predetermined value.

According to a second aspect of the invention, there is provided a coaxial connector comprising a contact, a shell, and a housing. The contact is electrically connected with an inner conductor of a coaxial cable. The shell is electrically connected with an outer conductor of the coaxial cable. The housing supports the contact and insulates the contact from the shell. At least one of the inductance of the portion consisting of the contact and the part of the inner conductor connected thereto other than covered by the outer conductor, and the capacitance between the portion and the shell is adjusted so that the characteristic impedance averaged among the part of the inner conductor other than covered by the outer conductor, the contact connected thereto, the housing, and the shell connected to the outer conductor is equal to the characteristic impedance of the coaxial cable in a region where the inner conductor is entirely covered by the outer conductor.

According to a third aspect of the invention, there is provided a coaxial connector comprising a contact, a shell, a housing, a flat region formed in the shell, and an adjustment area formed in the contact. The contact is electrically connected with an inner conductor of a coaxial cable. The shell is electrically connected with an outer conductor of the coaxial cable. The housing supports the contact and insulates the contact from the shell. The adjustment area is opposed to the flat region of the shell with the housing between them. The characteristic impedance averaged among the part of the inner conductor other than covered by the outer conductor, the contact connected thereto, the housing, and the shell connected to the outer conductor is increased and decreased in accordance with the size of the adjustment area. The size of the adjustment area is such that the averaged characteristic impedance is equal to the characteristic impedance of the coaxial cable in a region where the inner conductor is entirely covered by the outer conductor.

In any one of the above aspects, adjustment is made such that, when connecting the connector, the characteristic impedance of the coaxial cable becomes a predetermined value. Accordingly, even where a high frequency signal of gigahertz-class is transmitted through the coaxial cable, the characteristic impedance of the coaxial cable can be maintained thus enabling to improve the VSWR.

BRIEF DESCRIPTION OF THE DRAWINGS

Other and further objects, features and advantages of the invention will appear more fully from the following description taken in connection with the accompany drawings in which.

DESCRIPTION OF THE PREFERRED EMBODIMENTS

In the following, a coaxial connector in one preferred embodiment of the present invention will be explained with reference to the accompanying drawings.

Figure 1A:
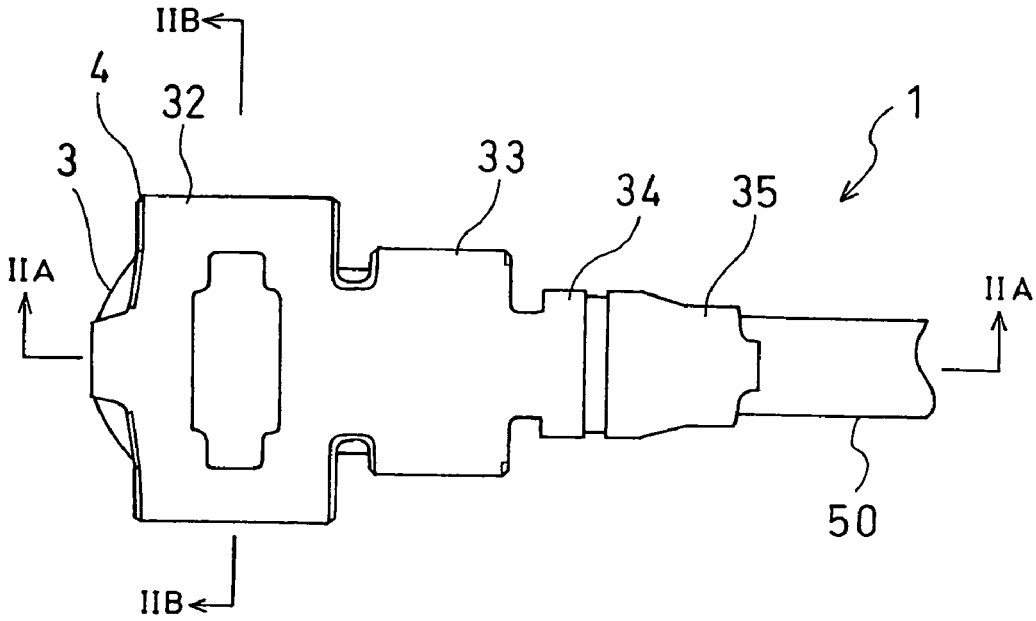
FIG. 1A is a top view of a coaxial connector in one embodiment of the present invention.
Figure 1B:
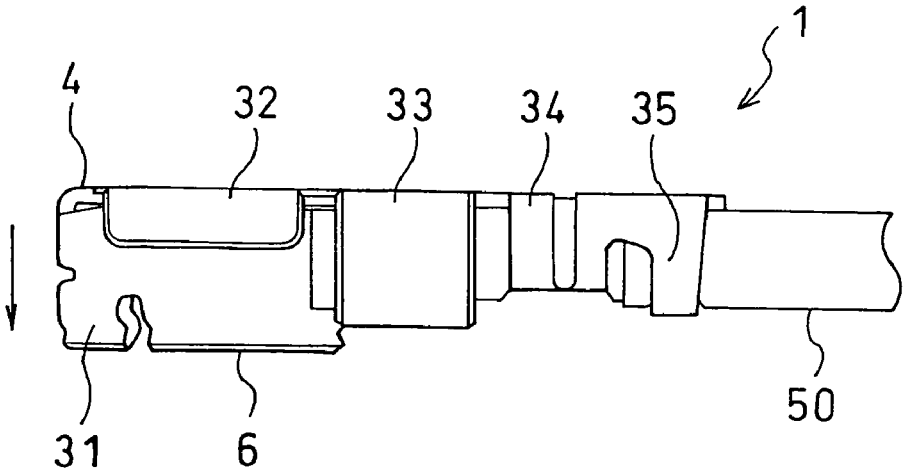
FIG. 1B is a side view of the coaxial connector shown in FIG. 1A.
Figure 2A:
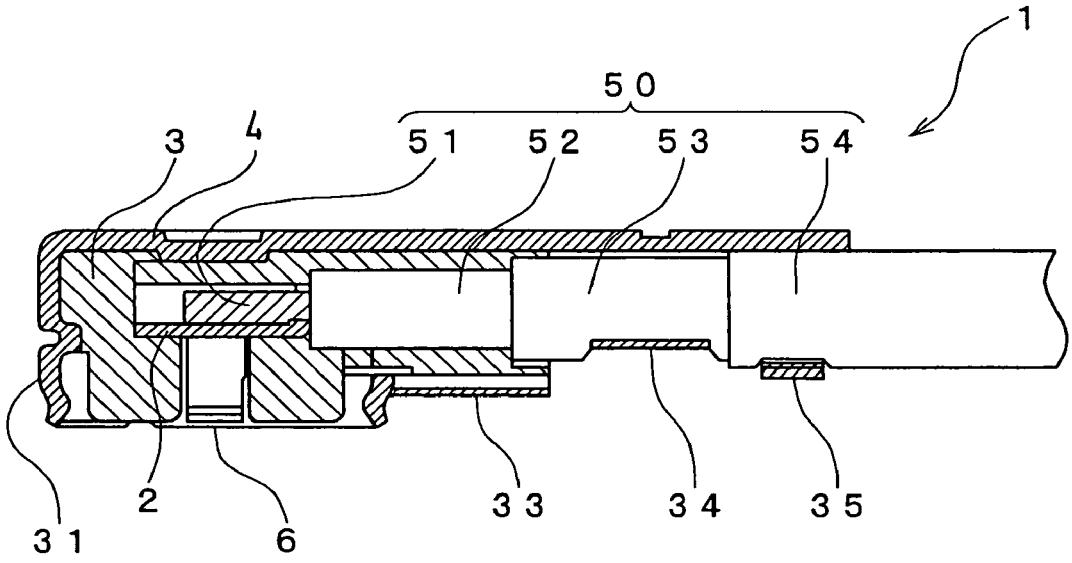
FIG. 2A is a sectional view along line IIA—IIA shown in FIG. 1A.
Figure 2B:
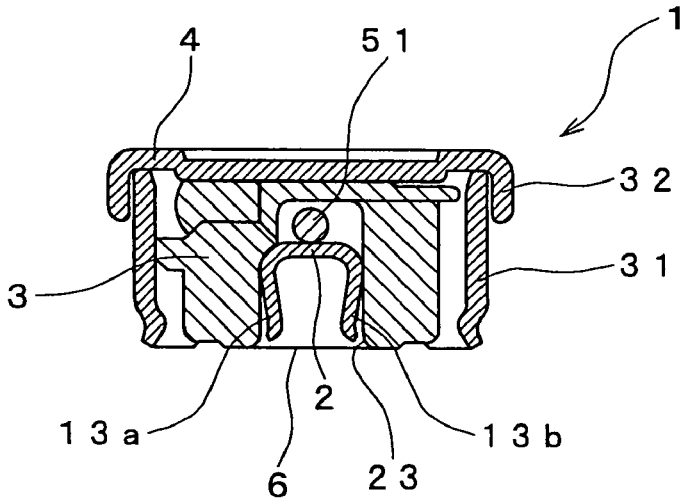
FIG. 2B is a sectional view along line IIB—IIB shown in FIG. 1A.

FIGS. 1A and 1B are exterior views of a coaxial connector 1 connected with a coaxial cable 50. FIG. 1A is a top view of the coaxial connector 1, while FIG. 1B is a left side view of the coaxial connector 1. The arrow in FIG. 1B represents the direction in which the coaxial connector 1 is connected to another connector (not shown). FIGS. 2A and 2B are views showing a sectional structure of the coaxial connector 1. FIG. 2A is a sectional view of the coaxial connector 1 on line IIA—IIA shown in FIG. 1A, while FIG. 2B is a sectional view of the coaxial connector on line IIB—IIB shown in FIG. 1A.

As shown in FIGS. 1*a*, 1B, 2A and 2B, the coaxial connector 1 has a contact 2, a housing 3, and a shell 4. The coaxial connector 1 also has a connection 6 at its underside (at the lower side in FIG. 1B), for connection with the other connector, as described later. That is, the coaxial connector 1 in the state where it is connected with the coaxial cable 50 is connected with the other connector in the direction perpendicularly to the axis of the coaxial cable 50. The coaxial cable 50 has a core 51 as an inner conductor for transmitting a signal, an insulator 52 covering the outer periphery of the core 51, a shield 53 as an outer conductor covering the outer periphery of the insulator 52, and a crust 54 covering the outer periphery of the shield 53. The coaxial cable 50 is connected with the coaxial connector 1 in a state where the core 51, the insulator 52, and the shield 53 are exposed in this order at respective predetermined lengths.

Figure 3A:
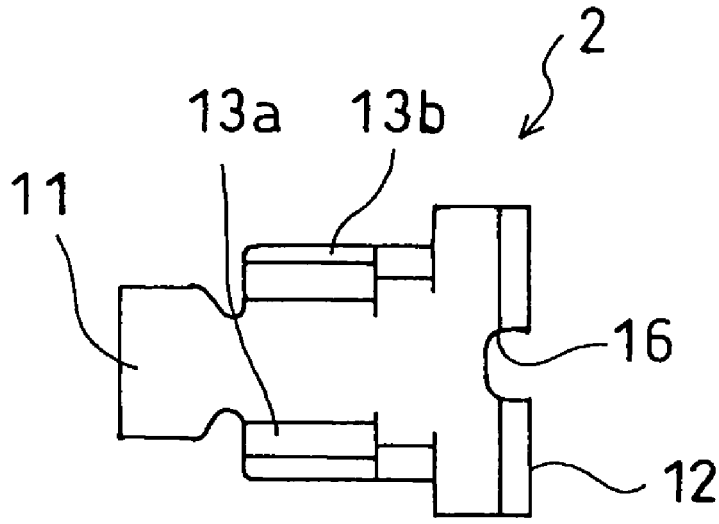
FIG. 3A is a top view of a contact included in the connector shown in FIG. 1A.
Figure 3B:
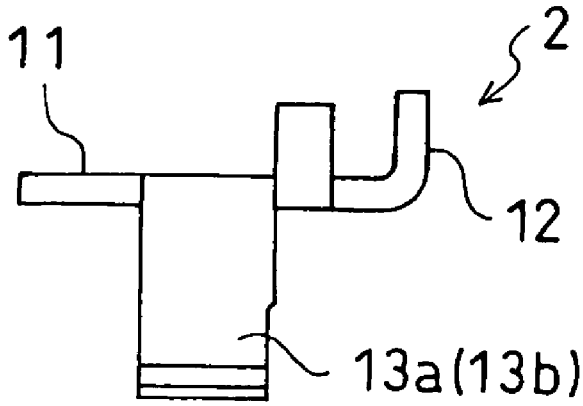
FIG. 3B is a side view of the contact shown in FIG. 3A.

The contact 2 is explained while referring to FIGS. 3A and 3B. FIGS. 3A and 3B are exterior views of the contact 2. FIG. 3A is a top view of the contact 2, while FIG. 3B is a left side view of the contact 2.

The contact 2 is a metal member to be electrically connected with the core 51 of the coaxial cable 50 and also with the other connector connected to the coaxial connector 1. The contact 2 has a capacitance adjustment plate 11 as a capacitance adjustment area or an adjustment area, a core grip 12 as an inner grip, and pin engagers 13*a* and 13*b*.

The capacitance adjustment plate 11 is a thin plate for adjusting the capacitance between the portion consisting of the part of the core 51 together with the insulator 52 exposed out of the shield 53 and the contact 2 connected to the core 51, and the shell 4. The capacitance adjustment plate 11 is formed on the contact 2 at its front side close to a tip of the coaxial cable 50 (in the left in FIGS. 3A and 3B). The capacitance adjustment plate 11 has a front end formed to be a straight-line, and on the opposite end cutouts are formed at opposing sides (in the upper and lower sides in FIG. 3A). The capacitance adjustment plate 11 is formed in a shape with a predetermined size, based on the capacitance between the portion consisting of the part of the core 51 together with the insulator 52 exposed out of the shield 53 and the contact 2 connected to the core 51, and the shell 4, this capacitance having a value causing the coaxial cable 50 connected to the coaxial connector 1 to have a characteristic impedance of a predetermined value (e.g. 50 Ω).

As mentioned above, the coaxial cable 50 when a high frequency signal is transmitting therethrough has a characteristic impedance $Z_0$ that is determined by the relationship between reactance L of the core 51 and capacitance C between the core 51 and the shield 53 (see Equation (1)). However, because, when the coaxial cable 50 is connected with the coaxial connector 1, the insulator 52 and core 51 are partly exposed out of the shield 53, there is a new occurrence of an inductive reactance $X_L$ in the part of the core 51 not covered by the shield 53, i.e., the part of the inner conductor other than covered by the outer conductor. Accordingly, when a high frequency signal transmits through the connector 1, the inductive reactance $X_L$ increases to an extent that it cannot be ignored. Thus, the characteristic impedance averaged among the part of the core 51 not covered by the shield 53, the contact 2 connected thereto, the housing 3, and the shell 4 becomes unequal to the characteristic impedance $Z_0$ of the coaxial cable 50 per se. Namely, the match of characteristic impedances worsens.

Accordingly, for the connector 1, capacitance is secured between the portion consisting of the part of the core 51 together with the insulator 52 exposed out of the shield 53 and the contact 2 connected to the core 51, and the shell 4, so that the inductive reactance $X_L$ is canceled out by the capacitive reactance $X_C$. That is, the characteristic impedance averaged among the part of the core 51 not covered by the shield 53, the contact 2 connected thereto, the housing 3, and the shell 4 is made equal to the characteristic impedance $Z_0$ of the coaxial cable 50 per se. Specifically, by changing the shape of the capacitance adjustment plate 11, the capacitance between the portion consisting of the part of the core 51 together with the insulator 52 exposed out of the shield 53 and the contact 2 connected to the core 51, and the shell 4 is adjusted to the capacitance that needs to be secured. As an example, by changing the length of the capacitance adjustment plate 11 along the axis of the coaxial cable 50, the size of the capacitance adjustment plate 11 may be adjusted to secure a desired capacitance. When increasing the capacitance to be secured, the capacitance adjustment plate 11 may be lengthened along the axis of the coaxial cable 50. When decreasing the capacitance to be secured, the capacitance adjustment plate 11 may be shortened along the axis of the coaxial cable 50.

In order to adjust the size of the capacitance adjustment plate 11 in this manner, there are kept ready a plurality of contacts 2 with different shaped capacitance adjustment plates 11, suited for the characteristic impedance of the coaxial cable 50 in use, e.g. contacts for 50 Ω and contacts for 70 Ω.

The core grip 12 is for electrically connecting the contact 12 and the core 51 of the coaxial cable 50. The core grip 12 is a bent portion with a substantially rectangular shape, extending vertically upward (upper in FIG. 3B) from the rear edge (right in FIG. 3B) of the contact 2. A cutout 16 is formed at the center of the core grip 12. When connecting between the coaxial connector 1 and the coaxial cable 50, the core 51 of the coaxial cable 50 is engaged in the cutout 16 of the core grip 12.

The pin engagers 13*a*, 13*b* are for engagement with pins of the other connector. The pin engagers 13*a*, 13*b* are two bent portions with substantially rectangular shapes, extending downward (downward in FIG. 3B) from around the centers of the left and right ends of the contact 2, respectively. The pin engagers 13*a*, 13*b* constitute a part of the connection 6. The pin engagers 13*a*, 13*b* are bent to be inclined inward, to decrease the spacing between the two toward the tip. Furthermore, the tip of the pin engager 13*a*, 13*b* is curved outward of the contact 2. When connecting between the coaxial connector 1 and the other connector, a pin of the other connector is inserted between the pin engagers 13*a*, 13*b* and held there by bending pressure.

In this manner, the contact 2 can be formed by bending a single sheet-formed metal plate that had been previously shaped. Meanwhile, the surface of the contact 2 is gold plated in order to increase electric conductivity. However, the material for plating of the contact 2 is not limited but may be another kind of metal, e.g. silver.

Figure 4A:
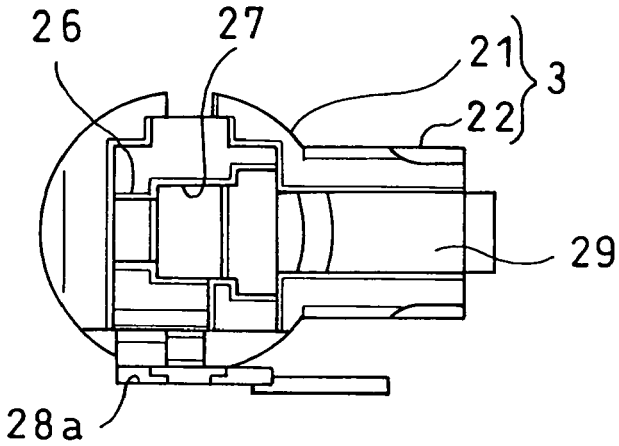
FIG. 4A is a top view of a housing included in the connector shown in FIG. 1A.
Figure 4B:
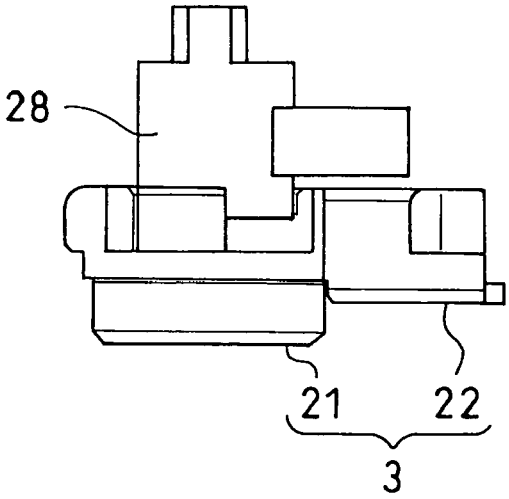
FIG. 4B is a side view of the housing shown in FIG. 4A.
Figure 4C:
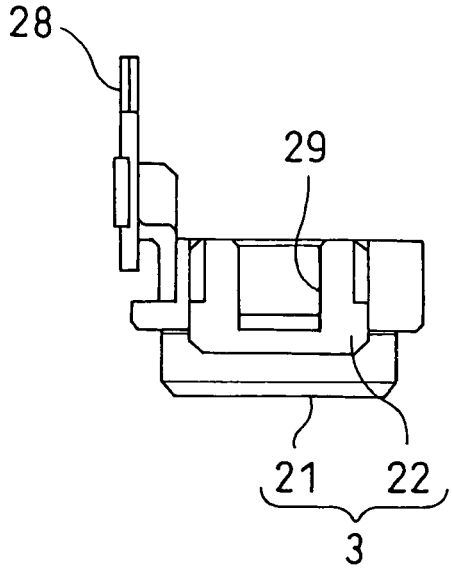
FIG. 4C is a rear view of the housing shown in FIG. 4A.

Now, the housing 3 is explained while referring to FIGS. 4A, 4B, and 4C. FIGS. 4A to 4C are exterior views of the housing 3. FIG. 4A is a top view of the housing 3, FIG. 4B is a left side view of the housing 3, and FIG. 4C is a rear view of the housing 3. FIGS. 4A to 4C show a state where a door 28, described later, is opened.

The housing 3 is a dielectric body arranged between the contact 2 and the shell 4 in order to support the contact 2 and to insulate the contact 2 from the shell 4 within the structure of the coaxial connector 1. Underside of the housing 3 (the lower side in FIG. 4B) constitutes the connection 6 together with the contact 2 and shell 4. The housing 3 has a contact receiver 21 as a contact grip in a cylindrical form to accommodate and grip the contact 2, and a cable receiver 22 in a rectangular form to receive the coaxial cable 50. The contact receiver 21 has a contact-arrangement hole 26, an engager-insertion hole 27, a door 28, and a pin-insertion hole 23 (see FIG. 2B). The contact receiver 21 has a cylindrical outer peripheral surface whose rear portion is integrally connected with one end face of the cable receiver 22.

The contact arrangement hole 26 is formed in the center of the upper surface (upper in FIG. 4B) of the contact receiver 21. When the contact 2 is received in the contact receiver 21, a flat portion of the contact 2 including the capacitance adjustment plate 11 is engaged in the contact arrangement hole 26.

The engager-insertion hole 27, with square shape, is formed at the bottom of the contact-arrangement hole 26. The engager-insertion hole 27 has an upper side communicating with the contact-arrangement hole 26 and a lower side communicating with the pin-insertion hole 23. When the contact 2 is received in the contact receiver 21, the two pin engagers 13*a*, 13*b* are inserted through the engager-insertion hole 27 and positioned at the respective sides of the pin-insertion hole 23.

The door 28 serves to open and close the contact-arrangement hole 26 and a cable-insertion groove 29 described later. The door 28 has one end face (the lower side in FIG. 4B) integrally connected with the upper left surface of the contact receiver 21 so that the door 28 extends along the axis of the coaxial cable 50. By bending this connection point, the door 28 can be opened and closed. Meanwhile, the door 28 has another end face (upper in FIG. 4B) having a lock mechanism to hold the door 28 in a closed state.

The pin-insertion hole 23 is formed in the center of the underside of the contact receiver 21 (the lower side in FIG. 4B), constituting a part of the connection 6. When the contact 2 is received in the contact receiver 21, the two pin engagers 13*a*, 13*b* inserted through the engager-insertion hole 27 are positioned at respective sides (the upper and the lower in FIG. 4B) in the pin-insertion hole 23. In this state, a pin of the mate connector of the coaxial connector 1 is inserted and engaged with the pin-insertion hole 23.

Figure 5C:
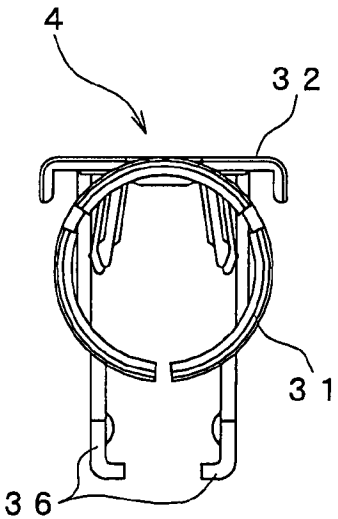
FIG. 5C is a front view of the shell shown in FIG. 5A.
Figure 5A:
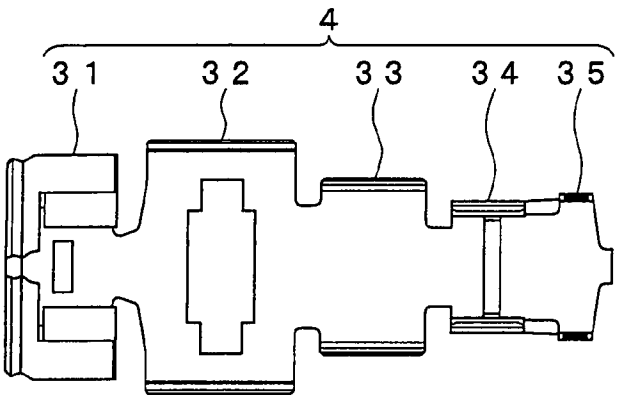
FIG. 5A is a top view of a shell included in the connector shown in FIG. 1A.
Figure 5B:
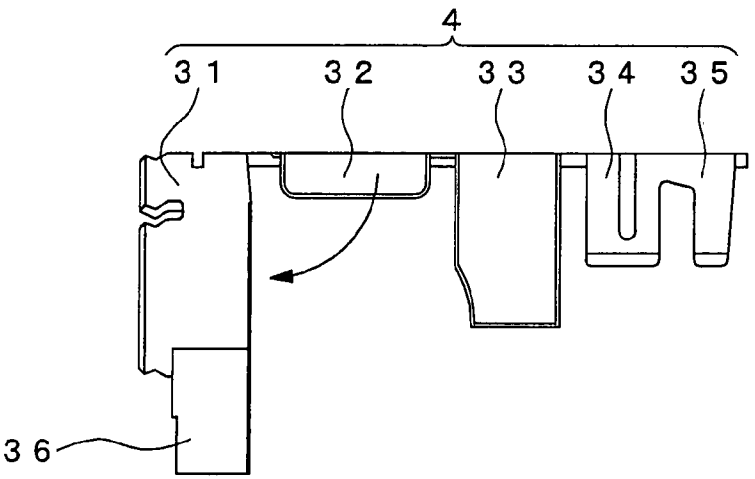
FIG. 5B is a side view of the shell shown in FIG. 5A.

Now, the shell 4 will be explained referring to FIGS. 5A, 5B, and 5C. FIGS. 5A to 5C are exterior views of the shell 4. FIG. 5A is a top view of the shell 4, FIG. 5B is a left side view of the shell 4, and FIG. 5C is a front view of the shell 4. FIGS. 5A to 5C illustrate the shell in a state prior to assembling of the coaxial connector 1. The arrow in FIG. 5B represents the direction of displacement of grips 32, 33, 34, 35 upon assembling the coaxial connector 1, as described later.

The shell 4 is a metal member to be electrically connected to the shield 53 of the coaxial cable 50 and to the other connector connected to the coaxial connector 1. The shell 4 has a housing engager 31 as a housing grip, a contact-receiver grip 32, a cable-receiver grip 33, a shield grip 34 as an outer grip and a cable grip 35 as a crust grip. These are formed arranged adjacently in linear order.

The housing engager 31 engages with the contact receiver 21 of the housing. Furthermore, when connecting the coaxial connector 1 with the other connector, the housing engager 31 engages a housing of the other connector, thus constituting a part of the connection 6. The housing engager 31 has a cylindrical form. Inserting the contact receiver 21 in the cylindrical space of the housing engager 31 results in their engagement. The housing engager 31 is formed by curving the two thin-plate portions at left and right (the upper and lower in FIG. 5A) at the front end (at the left in FIG. 5A, 5B) of the shell 4 into a semicircular form so that the edges of the thin plates face each other. The front end of the housing engager 31 is reduced in diameter in order to increase the pressure upon its engagement with the housing of the other connector. Two cutouts are formed on the front end of the housing engager 31. Accordingly, the housing engager 31 can be deflected when the connector 1 is inserted in or removed from the other connector. In the lower part of the outer periphery of the housing engager 31, thin holder plates 36*a*, 36*b* with substantially rectangular shapes are formed. The holder plates 36*a*, 36*b* increase the strength of the coaxial connector 1. While assembling the coaxial connector 1, after the front end of the housing engager 31 is placed facing down, the holder plates 36*a*, 36*b* are gripped together with the cable receiver 22 by the cable-receiver grip 33 (see FIGS. 1A and 1B).

In the state where the coaxial connector 1 is assembled, the contact-receiver grip 32 grips the contact receiver 21 of the housing 3 together with the housing engager 31. The contact-receiver grip 32 is arranged to the rear of and adjacent to the housing engager 31, and has two bent portions with substantially rectangular shapes extending downward (the lower side in FIG. 4B) from the left and right respective ends of the shell 4. By crimping the two bend portions with substantially rectangular shapes, the contact receiver 21 is gripped together with the housing engager 31 (see FIGS. 1A and 1B). The contact-receiver grip 32 has a flat region at its top surface. The top surface when the connector 1 is assembled is opposed to the flat surface of the capacitance adjustment plate 11, with the housing 3 between them. Further, a downward convex is formed around the center of the top surface. The flat region is in strong and close contact with the door 28 of the housing 3 when the coaxial connector 1 is assembled.

When the coaxial connector 1 is assembled, the cable-receiver grip 33 grips the cable receiver 22 of the housing 3 together with the holder plates 36*a*, 36*b* of the housing engager 31. The cable-receiver grip 33 is arranged to the rear of and adjacent to the contact-receiver grip 32, and has two bent portions with substantially rectangular shapes extending downward from the left and right respective ends of the shell 4. By crimping the bent portions, the cable receiver 22 is gripped together with the holder plates 36*a*, 36*b* (see FIGS. 1A and 1B).

The shield grip 34 grips an exposed portion of the shield 53 of the coaxial cable 51 when connecting the coaxial connector 1 with the coaxial cable 51. The shield grip 34 is arranged to the rear of and adjacent to the cable-receiver grip 33, and has two bent portions with U-shapes extending downward from the left and right ends of the shell 4. By crimping the bent portions, the shield 53 is gripped (see FIGS. 1A and 1B)

The cable grip 35 grips the coaxial cable 51 in connecting the coaxial connector 1 with the coaxial cable 51. The cable grip 35 is arranged to the rear of and adjacent to the shield grip 34, to have two bent portions with U-shapes extending downward from the left and right ends of the shell 4. By crimping the bent portions, the coaxial cable 51 is gripped (see FIGS. 1A and 1B). When assembling the coaxial connector 1, the grips 32 to 35 are displaced toward the housing engager 31 in the direction represented by the arrow in FIG. 5B, by bending substantially 90 degrees at the point where the contact-receiver grip 32 and the housing engager 31 are integrated.

In this manner, the shell 4 can be formed by bending a single metal sheet with predetermined shape. Meanwhile, gold plating is applied over the surface of the shell 4, in order to increase electric conductivity. However, the material for plating of the shell 4 is not limited but may be another kind of metal, e.g. silver.

Figure 6:
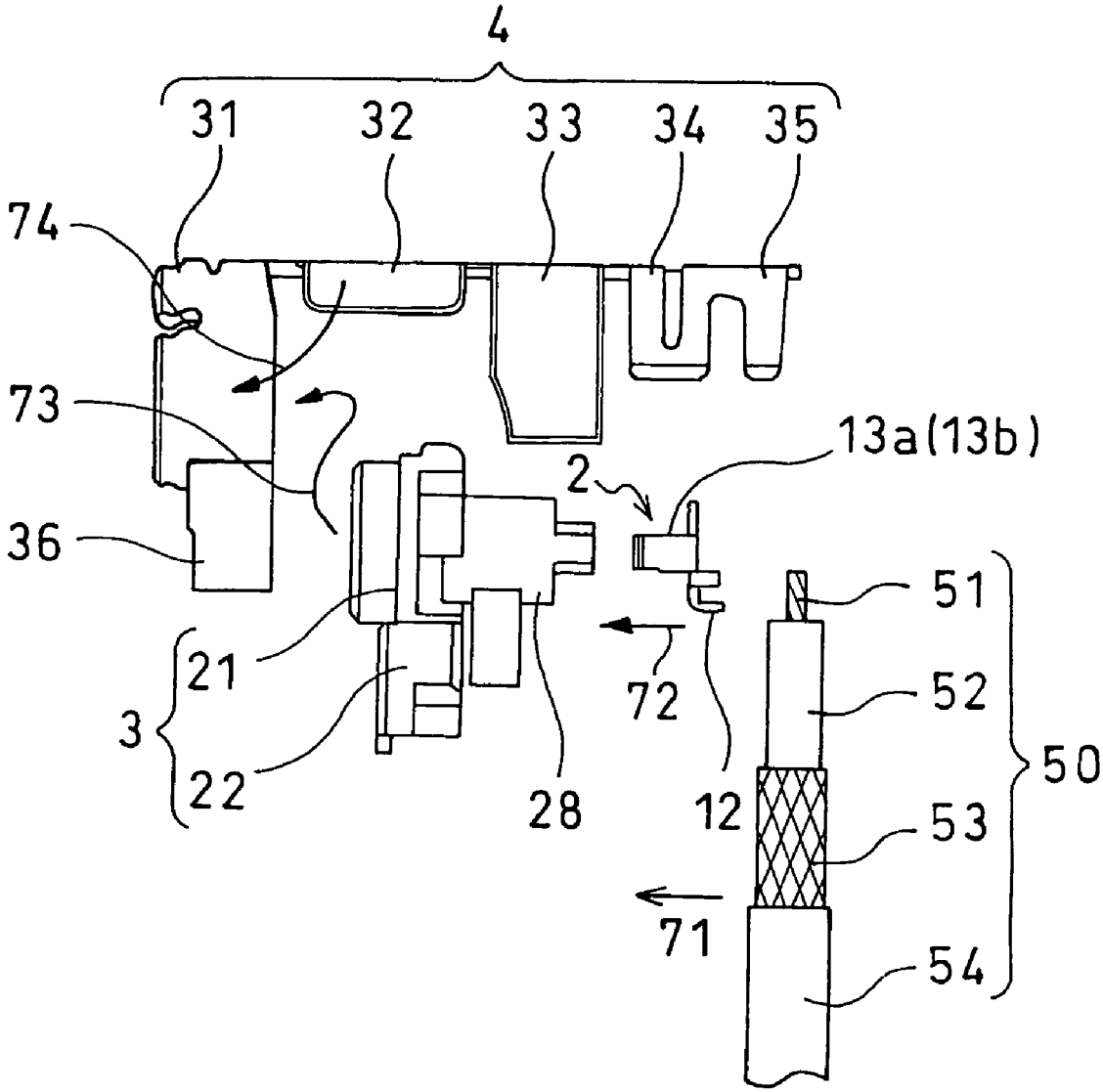
FIG. 6 is a view illustrating an assembling procedure of the coaxial connector shown in FIG. 1A.

Now, the procedure of assembling the coaxial connector 1 is explained referring to FIG. 6. FIG. 6 is a view showing the procedure of assembling the coaxial connector 1. The arrows 71, 72, 73, and 74 each represents the direction in which the component is moved during assembling.

At first, the core 51, the insulator 52, and the shield 53 of the coaxial cable 50 are successively exposed at predetermined lengths. The exposed core 51 is engaged in the cutout 16 of the core grip 12 of the contact 2, in the direction of the arrow 71 for example. This connects the contact 2 and the coaxial cable 50 together.

Then, the contact 2 connected with the coaxial cable 50 is received in the contact receiver 21 of the housing 3, in the direction of the arrow 72. At this time, the contact 2 is engaged in the contact-arrangement hole 26 of the contact receiver 21, and the two pin engagers 13*a*, 13*b* of the contact 2 are inserted in the engager-insertion hole 27 thus arranged in the pin-insertion hole 23. Meanwhile, the coaxial cable 50 is inserted in the cable-insertion hole 22 of the housing 3. Then, the coaxial cable 50 inserted in the cable receiver 22 is engaged in the cable-insertion groove 29 of the cable receiver 22. In this state, the door 28 of the housing 3 is closed. Closing the door 28 enables the contact 2 and the exposed core 51 of the coaxial cable 50 to be covered by a dielectric constituting the housing 3.

Then, the contact receiver 21 of the housing 3 connected with the coaxial cable 50 is inserted and engaged in the housing engager 31 of the shell 4, in the direction of the arrow 73. At this time, the connection 6 is configured by the two pin engagers 13*a*, 13*b* of the contact 2, the pin-insertion hole 23 of the contact receiver 21 of the housing 3, and the housing engager 31 of the shell 4.

Furthermore, each of the grips 32 to 35 of the shell 4 is bent, in the direction of the arrow 74, substantially 90 degrees at the point where the contact-receiver grip 32 and the housing engager 31 are integrated, toward the housing engager 31 constituting the connection 6. At this time, the housing engager 31 is clamped by the contact-receiver grip 32. Simultaneously, the holder plates 36*a*, 36*b* of the housing engager 31 and the cable receiver 22 of the housing 3 are clamped by the cable-receiver grip 33. At the same time, the exposed portion of the shield 53 of the coaxial cable 50 is clamped by the shield grip 34, while the coaxial cable 50 is clamped by the cable grip 35. Thus, the housing 3 is covered over with the shell 4. Particularly, the capacitance adjustment plate 11 of the contact 2 and the flat region of the contact-receiver grip 32 of the shell 4 are arranged to be parallel, strongly clamping the door 28 of the housing 3 and its vicinity therebetween.

Then, crimping is applied to the contact-receiver grip 32, the cable-receiver grip 33, the shield grip 34, and the cable grip 35. Due to this, the contact-receiver grip 32 grips the housing engager 31, the cable-receiver grip 33 grips the holder plates 36*a*, 36*b* and cable receiver 22, the shield grip 34 grips the shield 53, and the cable grip 35 grips the coaxial cable 50.

In the coaxial connector 1 assembled in the above procedure, the dielectric housing 3 covers the contact 2 connected to the core 51 exposed out of the shield 53. Furthermore, the shell 4 connected to the shield 53 covers the housing 3. Due to this, a predetermined capacitance is secured between the portion consisting of the contact 2 and the part of the core 51 connected thereto not covered by the shield 53, and the shell 4. Particularly, the door 28 of the housing 3 is arranged over and parallel with the upper surface of the capacitance adjustment plate 11 of the contact 2. Furthermore, the flat region of the contact-receiver grip 32 of the shell 4 is placed adjacent to the upper surface of the door 28. Thus, the door 28 is arranged between the capacitance adjustment plate 11 and the flat region of the contact-receiver grip 32 that are arranged parallel to each other (see FIGS. 1A and 1B), and the predetermined capacitance between the portion consisting of the contact 2 and the part of the core 51 connected thereto not covered by the shield 53, and the shell 4 is largely obtained.

According to the above-explained embodiment, when a high frequency signal is transmitted through the coaxial cable 50, the inductive reactance component generated at the portion constituting of the exposed part of the core 51 where the shield 53 is cut away and the contact 4 can be canceled by the electrostatic reactance component, which is adjusted by the capacitance adjustment plate 11, generated between the portion consisting of the contact 2 and the part of the core 51 connected thereto not covered by the shield 53, and the shell 4. Due to this, even when a high frequency signal of gigahertz-class is transmitted through the coaxial cable 50, it is possible to maintain the characteristic impedance of the coaxial cable 50 and improve VSWR.

Meanwhile, because of the parallel arrangement of the capacitance adjustment plate 11 of the contact 2 and the flat region of the contact-receiver grip 32 of the shell 4 as well as clamping the door 28 of the housing 3 therebetween, a required capacitance can be secured with efficiency.

Furthermore, because the capacitance adjustment plate 11 is formed extending along the core 51 of the coaxial cable 50, the coaxial connector 1 can take up less space.

In addition, a plurality of contacts 2 with capacitance adjustment plates 11 different in shape are prepared in accordance with the characteristic impedance of the coaxial cable 50, it is possible to readily adapt to a plurality of coaxial cables 50 with different characteristic impedance.

Meanwhile, because the contact 2 is provided with the core grip 12, sure connection is possible between the contact 2 and the core 51 of the coaxial cable 50. Also, because the housing 3 has the contact receiver 21, positive contact is obtained between the housing 3 and the contact 2. Furthermore, because the shell 4 has the contact-receiver grip 32, the cable-receiver grip 33, the shield grip 34 and the cable grip 35, sure connection is obtained between the coaxial connector 1 and the coaxial cable 50.

Furthermore, because the contact 2 and the shell 4 are each made of a single metal plate, the coaxial connector 1 can be reduced in cost.

In addition, because the coaxial connector 1 has the connection 6 to be connected with the other connector perpendicularly to the axis of the coaxial cable 50, less stress is applied from the coaxial cable 50.

The above-mentioned embodiment is structured to adjust the capacitance between the portion consisting of the part of the core 51 together with the insulator 52 exposed out of the shield 53 and the contact 2 connected to the core 51, and the shell 4. However, this structure is not limitative, i.e. the structure may instead adjust the inductance of the portion consisting of the contact 2 and the part of the core 51 connected thereto not covered by the shield 53, or the structure may adjust both the foregoing capacitance and inductance.

Also, the embodiment is structured to adjust the capacitance between the portion consisting of the part of the core 51 together with the insulator 52 exposed out of the shield 53 and the contact 2 connected to the core 51, and the shell 4 by means of the capacitance adjustment plate 11. However, that structure need not be used if the capacitance can be adjusted by other means. For example, the structure may instead adjust the capacitance between the portion consisting of the contact 2 and the part of the core 51 connected thereto not covered by the shield 53, and the shell 4, by changing the dielectric material of the housing 3.

Furthermore, although the embodiment is structured so that the capacitance adjustment plate 11 is formed in the contact 2, this structure is not limitative. The capacitance adjustment plate 11 may be alternatively formed in the shell 4.

Also, although the embodiment is structured so that the capacitance adjustment plate 11 is formed in a thin plate, another structure may be used provided that the required capacitance can be secured between the contact 2 and the shell 4. For example, it may be structurally formed in a rectangular or cylindrical form.

Furthermore, although the embodiment is structured so that the capacitance adjustment plate 11 is arranged parallel with the flat region of the contact-receiver grip 32 of the shell 4, another structure can be used provided that the required capacitance can be secured between the contact 2 and the shell 4. For example, the capacitance adjustment plate 11 may be structurally arranged obliquely to the flat region of the shell 4.

In addition, although the embodiment is structured so that the capacitance adjustment plate 11 is arranged extending along the axis of the coaxial cable 50, this structure is not limitative. The capacitance adjustment plate 11 may be structurally arranged at another angle, e.g. perpendicular to the axis of the coaxial cable 50.

Further, the embodiment adjusts the capacitance by changing the length of the capacitance adjustment plate 11 along the axis of the coaxial cable 50, but another structure may be used provided that the desired surface area thereof can be secured. For example, the structure may adjust the capacitance by changing the length of the capacitance adjustment plate 11 perpendicularly to the axis of the coaxial cable 50. Alternatively, the structure may adjust the capacitance by changing the shape of the flat capacitance adjustment plate 11 itself.

Meanwhile, although the contact 2 grips the core 51 of the coaxial cable 50 with the core grip 12, this structure is not limitative, i.e., the contact 2 and the core 51 may be connected by soldering, or the core 51 may be gripped by a member having another grip mechanism together with the core grip 12.

Meanwhile, although the housing 3 is structured to grip the contact 2 received within the contact receiver 21, this structure is not limitative. The contact 2 may be gripped by crimping a thin plate, or there may be a structure which does not grip the contact 2. In the case the contact 2 is not gripped, the contact 2 may be fixed on the housing 3 by an adhesive. Otherwise, the structure may be additionally provided with a member having another grip mechanism, gripping the contact 2 together.

Furthermore, although the shell 4 is structured to grip the housing 3 by the housing engager 31, contact-receiver grip 32 and cable-receiver grip 33, and to grip the coaxial cable 50 by the shield grip 34 and cable grip 35, this structure is not limitative. The structure need have only a part of these grips, or the structure may hold the shell 4 together with the housing 3 by a member having another grip mechanism instead of having these grips.

Meanwhile, although the embodiment is structured so that the contact 2 and the shell 4 are each made of a single metal plate, this structure is not limitative, e.g. they each may be formed by a combination of metal plates.

Furthermore, although the embodiment is structured so that the coaxial connector 1 is to be connected with the other connector perpendicularly to the axis of the coaxial cable 50, this structure is not limitative, e.g. the structure may be to be connected with the other connector coaxially with the coaxial cable 50.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

The invention claimed is:

1. A coaxial connector comprising:

a contact electrically connected with an inner conductor of a coaxial cable;

a shell electrically connected with an outer conductor of the coaxial cable; and a housing that supports the contact and insulates the contact from the shell;

wherein at least one of the inductance of the portion consisting of the contact and the part of the inner conductor connected thereto other than covered by the outer conductor, and the capacitance between the portion and the shell is adjusted so that the characteristic impedance averaged among the part of the inner conductor other than covered by the outer conductor, the contact connected thereto, the housing, and the shell connected to the outer conductor is equal to the characteristic impedance of the coaxial cable in a region where the inner conductor is entirely covered by the outer conductor.

2. The coaxial connector according to claim 1, wherein at least one of the contact and the shell has a capacitance adjustment area, wherein the capacitance adjustment area is adjusted so that the capacitance between the portion and the shell has a value for configuring the averaged characteristic impedance.

3. The coaxial connector according to claim 2, wherein the capacitance adjustment area is made in the form of a thin plate.

4. The coaxial connector according to claim 2, wherein a part opposed to the capacitance adjustment area in the contact and the shell has a region parallel with the capacitance adjustment area.

5. The coaxial connector according to claim 2, wherein the capacitance adjustment area is formed so as to extend along the axis of the coaxial cable.

6. The coaxial connector according to claim 2, wherein the capacitance adjustment area has its width along the axis of the coaxial cable determined based on the capacitance that needs to be secured between the portion and the shell.

7. The coaxial connector according to claim 1, wherein the contact has an inner grip for gripping the inner conductor of the coaxial cable.

8. The coaxial connector according to claim 1, wherein the housing has a contact grip for gripping the contact.

9. The coaxial connector according to claim 1, wherein the shell has at least one of a crust grip for gripping a crust of the coaxial cable, an outer grip for gripping the outer conductor of the coaxial cable, and a housing grip for gripping the housing.

10. The coaxial connector according to claim 1, wherein the contact is made from a single metal plate.

11. The coaxial connector according to claim 1, wherein the shell is made from a single metal plate.

12. The coaxial connector according to claim 1, wherein the axis of the coaxial cable is perpendicularly to a direction where the coaxial connector is connected to another connector.

13. The coaxial connector according to claim 1, wherein a signal of gigahertz-class is to transmit through the coaxial cable.

14. A coaxial connector comprising:

a contact electrically connected with an inner conductor of a coaxial cable;

a shell electrically connected with an outer conductor of the coaxial cable; and a housing that supports the contact and insulates the contact from the shell;

a flat region formed in the shell; and an adjustment area formed in the contact, the area being opposed to the flat region of the shell with the housing between them;

wherein the characteristic impedance averaged among the part of the inner conductor other than covered by the outer conductor, the contact connected thereto, the housing, and the shell connected to the outer conductor is increased and decreased in accordance with the size of the adjustment area; and the size of the adjustment area is such that the averaged characteristic impedance is equal to the characteristic impedance of the coaxial cable in a region where the inner conductor is entirely covered by the outer conductor.

15. The coaxial connector according to claim 14, wherein the adjustment area and the flat region are opposed to each other with an air space between them.

16. The coaxial connector according to claim 14, wherein an end of the inner conductor is disposed between the contact and the shell.

* * * * *